US006723142B2

(12) United States Patent
Emerson et al.

(10) Patent No.: US 6,723,142 B2
(45) Date of Patent: Apr. 20, 2004

(54) PREFORMED ABRASIVE ARTICLES AND METHOD FOR THE MANUFACTURE OF SAME

(75) Inventors: Grahame Emerson, Buena Park, CA (US); Michael Salyards, Hesperia, CA (US)

(73) Assignee: Tepco Ltd., Simi Valley, CA (US)

( * ) Notice: Subject to any disclaimer, the term of this patent is extended or adjusted under 35 U.S.C. 154(b) by 20 days.

(21) Appl. No.: 10/164,189

(22) Filed: Jun. 5, 2002

(65) Prior Publication Data

US 2003/0226318 A1 Dec. 11, 2003

(51) Int. Cl.[7] ..... B24D 3/00; B24D 18/00

(52) U.S. Cl. ..... 51/295; 51/297; 51/298; 51/307; 51/308; 51/309; 451/526

(58) Field of Search ..... 51/295, 297, 298, 51/307, 308, 309; 451/526

(56) References Cited

U.S. PATENT DOCUMENTS

| | | | | |
|---|---|---|---|---|
| 2,349,365 A | | 7/1936 | Martin | |
| 2,746,216 A | | 5/1956 | Hollingsworth | |
| 3,413,674 A | | 12/1968 | Reid | |
| 3,688,453 A | | 9/1972 | Legacy | |
| 4,331,453 A | | 5/1982 | Dau | |
| 4,355,489 A | | 10/1982 | Heyer | |
| 4,809,467 A | | 3/1989 | De Fazio | |
| 5,007,128 A | | 4/1991 | Englund | |
| 5,046,288 A | | 9/1991 | Scheider | |
| 5,109,637 A | * | 5/1992 | Calafut | 451/495 |
| 5,329,730 A | | 7/1994 | Scheider | |
| 5,396,737 A | | 3/1995 | Englund | |
| 5,454,751 A | | 10/1995 | Wiand | |
| 5,482,756 A | | 1/1996 | Berger | |
| 5,667,540 A | | 9/1997 | Chesley | |
| 5,775,984 A | | 7/1998 | Olson | |
| 5,791,330 A | | 8/1998 | Tselesin | |
| 5,858,140 A | | 1/1999 | Berger | |
| 5,885,149 A | | 3/1999 | Gillet | |
| 5,919,549 A | | 7/1999 | Van | |
| 6,001,009 A | | 12/1999 | Kaiser | |
| 6,048,254 A | | 4/2000 | Duescher | |
| 6,095,910 A | | 8/2000 | Luedeke | |
| 6,251,002 B1 | | 6/2001 | Close | |

* cited by examiner

*Primary Examiner*—Michael Marcheschi
(74) *Attorney, Agent, or Firm*—Foley & Lardner LLP

(57) ABSTRACT

A non-woven abrasive article of interlaced fibers and abrasive particles and a binder which is preformed into a predetermined three dimensional shape and a method for manufacturing the same. The abrasive article is preformed by a thermal setting the abrasive article while it is maintained in a predetermined three dimensional shape or by heating the article to its glass transition temperature and then cooling the article below the glass transition temperature while it is maintained in a predetermined three dimensional shape. This method allows the manufacture of preformed abrasive articles in various three dimensional shapes, including, for example, a bull nosed shape suitable for finishing a concavely curved surface.

21 Claims, 3 Drawing Sheets

PREFORMED ABRASIVE ARTICLES AND METHOD FOR THE MANUFACTURE OF SAME

BACKGROUND OF THE INVENTION

Non-woven, lofty, three-dimensional, fibrous abrasive products have been employed to remove corrosion, excess material, surface defects, burrs and impart desirable surface finishes on various articles of aluminum, brass, copper, steel, wood and the like. Non-woven, lofty, three-dimensional, fibrous abrasive products made according to teaching of the patents described below have been in wide use for quite some time.

Various abrasive articles may be used to abrade the existing surface of the materials described above to remove existing imperfections and finalize the surfaces. Typically, coated abrasive paper, cloth or vulcanized fiber disk, (typically mounted on a powered right-angled tool) are all suitable for the foregoing initial abrasive application. Available abrasive disks, while being sufficiently aggressive and capable of accomplishing the needed rough preparation of the surface typically leave visible grinding marks on the surface which often need to be removed. Consequently, additional surface preparation is often needed to remove the grinding marks to obtain the desired finished surface. This additional corrective surface preparation includes a finishing step of using successively finer grades of coated abrasive materials or using a non-woven abrasive to sufficiently decrease surface roughness and remove the grinding marks or other small imperfections.

Non-woven abrasive surface conditioning articles have been used in a wide variety of abrasive applications and are known to leave acceptable surface finishes, and non-woven abrasive surface conditioning articles generally have long useful lives.

Non-woven and coated abrasive articles have been described in the patent literature.

U.S. Pat. No. 2,958,593 (Hoover et al.) describes low density open non-woven fibers abrasive articles having a high void volume (e.g. low density). The non-woven webs of the '593 patent are comprised of short fibers bonded together at their points of mutual contact to form a three dimensional integrated structure. Fibers may be bonded to one another with a resin/abrasive mixture, forming globules at the points of mutual contact while the interstices between the fibers remain substantially unfilled by resin or abrasive. The void volume of the disclosed structures typically exceed 90%.

U.S. Pat. No. 3,688,453 (Legacy et al.) describes abrasive articles such as belts suitable for off hand and automated article finishing. The belts comprise a lofty non-woven web that is attached to a woven backing by needle tacking. The web is impregnated with resin and abrasive. According to Example 1, the webs are coated with a resin/abrasive slurry which is then dried to provide the finished article. The resin/abrasive is applied to achieve a dry coating weight 169 grains per 4 inch by 6 inch pad (708 g/m sup 2) and then is coated with a second abrasive/adhesive slurry at 78 grains per 4 inch by 6 inch pad (327 g/m sup 2).

U.S. Pat. No. 4,331,453 (Dau et al.) describes and abrasive articles comprising a lofty, non-woven, three dimensional abrasive web adhesively bonded to stretch-resistant woven fabric with a polyurethane binder. The resin coating weights for the articles of the '453 patent, as stated in Example 1, are about 70 grains of an adhesive composition per 4 inch by 6 inch pad (293 g/m sup 2) followed by final abrasive-adhesive slurry at a dry coating weight of 225 grains per grains per 4 inch by 6 inch pad (942 g/m sup 2).

U.S. Pat. No. 5,178,646 (Barber, Jr. et al.) describes coatable thermally curable binder precursor solutions modified with a reactive diluent and an abrasive articles incorporating such binder precursor solutions. The coated abrasive articles of the '646 patent include a flexible backing such as a paper sheet or a cloth backing.

U.S. Pat. No. 5,306,319 (Krishnan et al.) describes surface treating articles utilizing an organic matrix such as non-woven web that is substantially engulfed by a tough, adherent elastomeric resinous binder system. The articles of the '319 patent principally comprise surface treating wheels.

European Patent Application 0716903 A1 describes a coated abrasive product comprised of base resin coat, abrasive mineral grains and a size resin coat all applied on flexible backing material consisting of a non-woven fiber mat. The non-woven fiber mat is formed into a flat, wear and tear resistant backing by means of a binder or by the superficial dissolving or fusing of fibers. An abrasive layer comprising abrasive grain may be coated onto one or both sides of the non-woven fiber mat.

In general, the prior art describes non-woven abrasive articles where the working surface of the non-woven abrasive article is a relatively flat, two-dimensional surface. Such non-woven abrasive articles are difficult to use on curved surfaces, especially concavely curved surfaces or surfaces with interior curves (i.e., curves less than 180 degrees), because the non-woven abrasive article must be deformed while in use through the application of force in order to conform to such curved working surfaces. The use of prior art non-woven abrasive articles on such curved surfaces tends to require a higher level of skill and attention to avoid gouging the surface or removing excess material from the surface. Even with a skilled operator, the use of flat non-woven abrasive articles tends to result in a non-uniform surface finish. In addition, the deformation of the non-woven abrasive through the application of force in use tends to weaken the non-woven abrasive, thereby reducing its useful life.

The prior art does not teach or disclose the use of a non-woven abrasive article which is preformed into a three-dimensional shape prior to its use. Such three-dimensional forming reduces or eliminates the need to deform the non-woven abrasive article through the application of force while the article is being used, thereby resulting in improved uniformity of abrading effect, lowering the level of skill required for use on curved surfaces, and prolonging the useful life of the non-woven abrasive article.

BRIEF DESCRIPTION OF THE DRAWINGS

In describing the preferred embodiment, reference is made to the various Figures, wherein.

SUMMARY OF THE INVENTION

Figure 1:
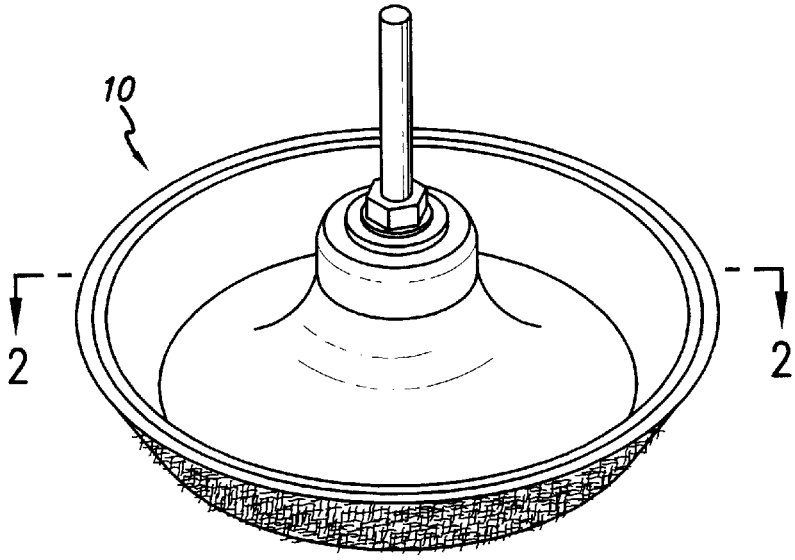
FIG. 1 is a perspective view of an abrasive article of the invention.
Figure 2:
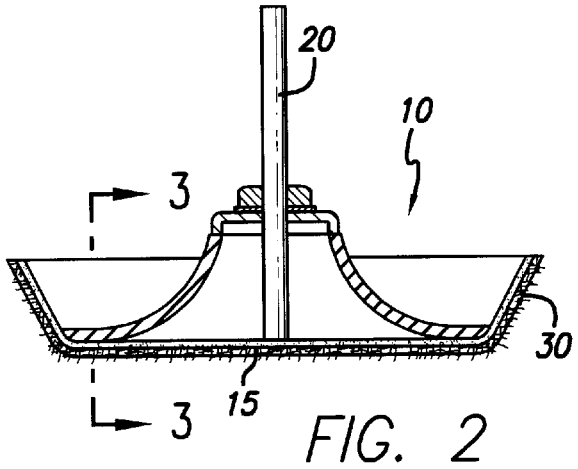
FIG. 2 is a cross-sectional view of the non-woven abrasive disk of FIG. 1.
Figure 3:
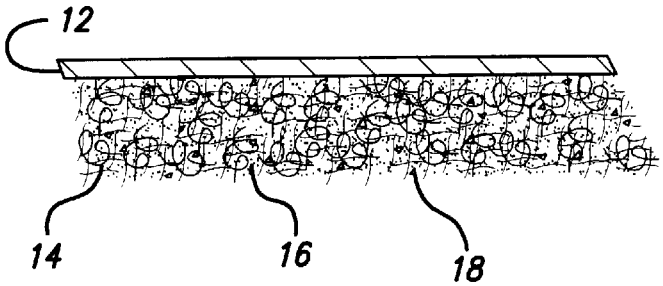
FIG. 3 is an enlarged side elevational view of the non-woven abrasive disk of FIG. 2.
Figure 4:
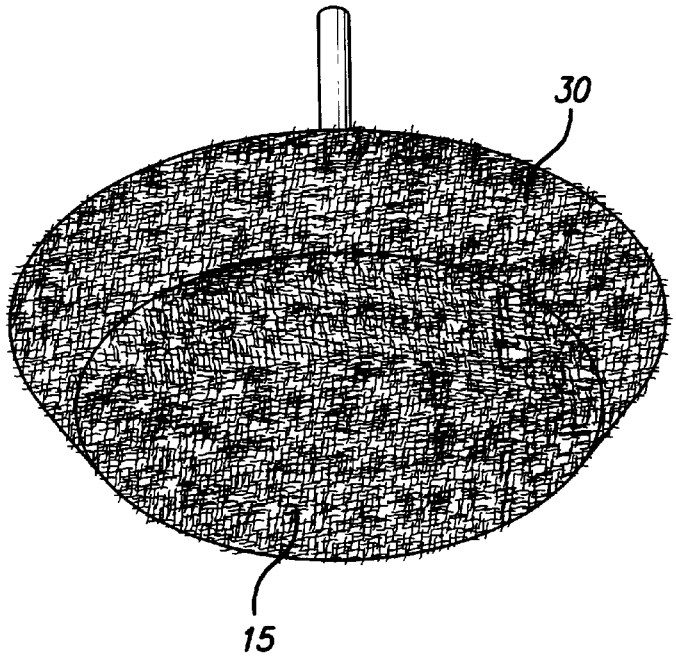
FIG. 4 is a perspective view of the non-woven abrasive disk of FIG. 1.

The present invention provides for a non-woven abrasive article useful in a variety of surface conditioning and preparation operations and a method for the manufacture of such articles.

In one aspect, the present invention provides for an abrasive article comprising:

a lofty, three-dimensional, non-woven web of interlaced fibers having a major surface;

abrasive particles attached to said fibers;

a binder bonding the fibers to one another at their mutual contact points and attaching said abrasive particles to said fibers; and wherein a portion of the article is preformed in a direction perpendicular to the major surface of the web of fibers.

The lofty, three-dimensional, non-woven web of interlaced fibers is preferably made from thin thread-like synthetic fibers, forming a sheet of material having at least one major or working surface. For example, the circular face of a disk would be a major or working surface of such a disk. In the present invention, a portion of the article is preformed (i.e., non-detrimentally formed prior to use) in a direction perpendicular to the major surface of the web of fibers. A mushroom-shaped or bullhead-shaped article would be an example of a thin disk wherein a portion of the disk is preformed in a direction perpendicular to the major surface of the disk.

In another aspect, the present invention provides for an abrasive article, comprising:

a lofty non-woven fabric made of interlaced fibers;

abrasive particles attached to the fibers of the non-woven fabric;

a binder attaching said abrasive particles to said fibers; and wherein the article is rotatable about an axis of rotation and a portion of the fabric is preformed in a direction away from a plane perpendicular to the axis of rotation.

This aspect of the invention results in an abrasive article which may, for example, be fitted with a shaft along its axis of rotation and driven by a power tool for the purpose of abrading the working surface.

In another aspect, the invention provides for a method of manufacturing such a preformed non-woven abrasive article, comprising the steps of:

heating at least a portion of a lofty non-woven abrasive article to its plasticizing temperature;

forming the non-woven abrasive article into a predetermined three-dimensional shape; and maintaining the three-dimensional formation of the non-woven abrasive article while it cools below its plasticizing temperature.

In this aspect of the invention, the plasticizing temperature is the temperature at which the non-woven abrasive fabric sheet becomes formable in a manner where it will retain a shape and structural integrity after it is cooled below the plasticizing temperature.

In another aspect of this invention, a non-abrasive article comprising a lofty three-dimensional web of fibers with a thermosetting binder and abrasive particles attached to the fibers, is thermoset while the article is formed in a predetermined three-dimensional shape.

Additional aspects of the invention are described below. Further details of the invention will be appreciated by those skilled in the art upon consideration of the remainder of the disclosure, including the detailed description of the preferred embodiments and the appended claims.

DETAILED DESCRIPTION OF THE PREFERRED EMBODIMENTS

The described embodiments are not to be construed as unduly limiting the scope of the present invention. In describing the preferred embodiments, structural details are depicted in the Figures and are referred to by use of reference numerals wherein like numbers indicate like structures.

Referring to the Figures, the invention provides a variety of abrasive articles 10 such as a disc. The abrasive article 10 includes an optional backing 12, a lofty, open, low-density, fibrous, non-woven web of fibers 14, a binder 16 and abrasive particles 18 adhered within the binder 16 to the non-woven web of fibers 14.

The backing 12 preferably is a dimensionally stable woven scrim cloth comprised of multi-filament tensilized organic fibers. The fibers should be able to withstand the temperatures at which the binder is applied and cured without deterioration. Suitable fibers include nylon and polyester, and the backing 12 will preferably have a relatively open weave which may permit a degree of cooling when the article 10 is in use. Suitable materials for use as the reinforcing fabric in the articles of the invention include, without limitation, thermobonded fabrics, knitted fabrics, stitch-bonded fabrics and the like. However, the invention is not to be limited to one reinforcing fabric over another, or to require any such backing 12.

A lofty, open, low-density, fibrous, non-woven web of fibers 14 is affixed to the backing 12. The non-woven web 14 preferably comprises at least one major web surface. A major web surface is generally indicated by numeral 15 and forms the primary working surface of the article 10. The web 14 is made of a suitable synthetic fiber capable of withstanding the temperatures at which impregnating resins and adhesive binders are cured without deterioration. Fibers suitable for use in the articles of the invention include natural and synthetic fibers, and mixtures thereof. Synthetic fibers are preferred including those made of polyester (e.g., polyethylene terephthalate), nylon (e.g., hexamethylene adipamide, polycaprolactum), polypropylene, acrylic (formed from a polymer of acrylonitrile), rayon, cellulose acetate, polyvinylidene chloride-vinyl chloride copolymers, vinyl chloride-acrylonitrile copolymers, and so forth. Suitable natural fibers include those of cotton, wool, jute, and hemp. The fiber used may be virgin fibers or waste fibers reclaimed from garment cuttings, carpet manufacturing, fiber manufacturing, or textile processing, for example. The fiber material can be a homogenous fiber or a composite fiber, such as bicomponent fiber (e.g., a co-spun sheath-core fiber). It is also within the scope of the invention to provide an article comprising different fibers in different portions of the web (e.g., a first web portion, a second web portion and a middle web portion). The fibers of the web are preferably tensilized and crimped but may also be continuous filaments such as those formed by an extrusion process described in U.S. Pat. No. 4,227,350 to Fitzer, incorporated herein by reference. Those skilled in the art will understand that the invention is not limited by the nature of the fibers employed or by their respective lengths, linear densities and the like.

The non-woven web 14 may be made by conventional air-laid, carded, stitch-bonded, spunbonded, wet laid, or melt blown procedures. One preferred non-woven web is an air laid web, as described by Hoover et al. in U.S. Pat. No. 2,958,593, incorporated herein by reference. The non-woven web 14 may be formed on commercially available air lay equipment such as that available under the trade designation 'Rando-Weber' commercially available from Rando Machine Company of Macedon, N.Y. Those skilled in the art will appreciate that the invention is not to be unduly limited to any particular method for the manufacture of the web 14.

One or more binders 16 are typically used to bond the fibers in the web 14 to one another at their mutual contact points. The binder or binders 16 preferably comprise a coatable resinous adhesive which, upon hardening by thermal curing or the like, form an adhesive layer to hold the fibers of the web 14 to one another. Any of a variety of known materials may be used as a binder or binders including those described below. Preferred are materials which, upon hardening, form tough, flexible, rubbery or elastomeric binders. Preferred binders include materials such as polyurethanes, polyureas, styrene-butadiene rubbers, nitrile rubbers, and polyisoprene.

Abrasive particles 18 are adhered within the binder 16 to impart a desired abrasive character to the finished article 10. There are two main types of abrasive particles 18, inorganic abrasive particles and organic based particles. Inorganic abrasives particles can further be divided into hard inorganic abrasive particles (e.g., having a Moh hardness greater than 8) and soft inorganic abrasive particles (e.g., having a Moh hardness less than 8).

Examples of conventional hard inorganic abrasive particles include fused aluminum oxide, heat treated aluminum oxide, white fused aluminum oxide, ceramic aluminum oxide materials such as those commercially available under the trade designation 'Cubitron' (available from Minnesota Mining and Manufacturing Company, St. Paul, Minn.), black silicon carbide, green silicon carbide, titanium diboride, boron carbide, tungsten carbide, titanium carbide, diamond, cubic boron nitride, garnet, fused alumina zirconia, sol gel abrasive particles and the like. Examples of sol gel abrasive particles can be found in U.S. Pat. Nos. 4,314,827, 4,623,364; 4,744,802, 4,770,671; 4,881,951, all incorporated herein after by reference. It is also contemplated that the abrasive particles could comprise abrasive agglomerates such as those described in U.S. Pat. Nos. 4,652,275 and 4,799,939, the disclosures of which are incorporated herein by reference.

Examples of softer inorganic abrasive particles include silica, iron oxide, chromia, ceria, zirconia, titania, silicates and tin oxide. Still other examples of soft abrasive particles include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, aluminum trihydrate, graphite, metal oxides (such as calcium oxide (lime), aluminum oxide, titanium dioxide) and metal sulfites (such as calcium sulfite), metal particles (tin, lead, copper and the like) glass particles, glass spheres, glass bubbles, flint, talc, emery, and the like.

Organic based particles include plastic abrasive particles formed from a thermoplastic material such as polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon and combinations thereof. Preferred thermoplastic polymers are those possessing a high melting temperature and/or having good heat resistance properties. In the formation of thermoplastic particles, the polymer material may be formed into elongate segments (e.g., by extrusion) and cut into the desired length. Alternatively, thermoplastic polymer can be molded into a desired shape and particle size by, for example, compression molding or injection molding.

Organic abrasive particles can also comprise a crosslinked polymer such as those resulting from the polymerization of phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins and mixtures thereof. These crosslinked polymers can be made, crushed and screened to the appropriate particle size and particle size distribution.

The articles of the invention may contain a mixture of two or more different abrasive particles such as a mixture of hard inorganic abrasive particles and soft inorganic abrasive particles or a mixture of two soft abrasive particles. In the mixture of two or more different abrasive particles, the individual abrasive particles may have either similar average particle sizes or the individual abrasive particles may have a different average particle sizes. In yet another aspect, there may be a mixture of inorganic abrasive particles and organic abrasive particles. Additional details concerning the manufacture and properties of the lofty, non-woven abrasive fabric sheet, including the binder or binders used and the possible abrasive particles can be found in U.S. Pat. No. 5,919,549 (Van, et al.) incorporated herein by this reference.

An alternative method of manufacturing the non-woven abrasive fabric used in the present invention consists of laying multiple layers of the non-woven abrasive fabric described above on top of one another, and bonding the layers of fabric together, through various processes known in the art. Such multilayer fabrics are known in the trade as a "unitized" non-woven abrasive. The invention described herein is equally applicable to such "unitized" non-woven abrasive articles.

Abrasive articles of the types described above are frequently used with power driven rotary tools, such as grinders or powered right-angle tools. An individual non-woven abrasive article 10 is typically stamped or cut from a larger sheet of the non-woven abrasive fabric manufactured as described above. The individual abrasive article 10 may be made in the shape of a circular disk or other desirable shape. A shaft 20 (or shaft attachment mechanism) is attached to the side of the disk opposite the working surface of the disk through various known methods, including methods commonly known in the trade as SocAtt, Lockit, ClickOn, Speed-Lock (® Norton Company), Roloc (® 3M Company), hook and loop fastener (e.g. Velcro® Velcro Industries, B.V.) and Power-Lock (® Merit Abrasives). The disk is then attached through the shaft to a power driven rotary to tool. The disk is rotated and the working surface 15 of the disk is brought in contact with the workpiece 22 to remove corrosion, surface defects, burrs, or provide desirable surface finish on the workpiece 22.

Figure 5:
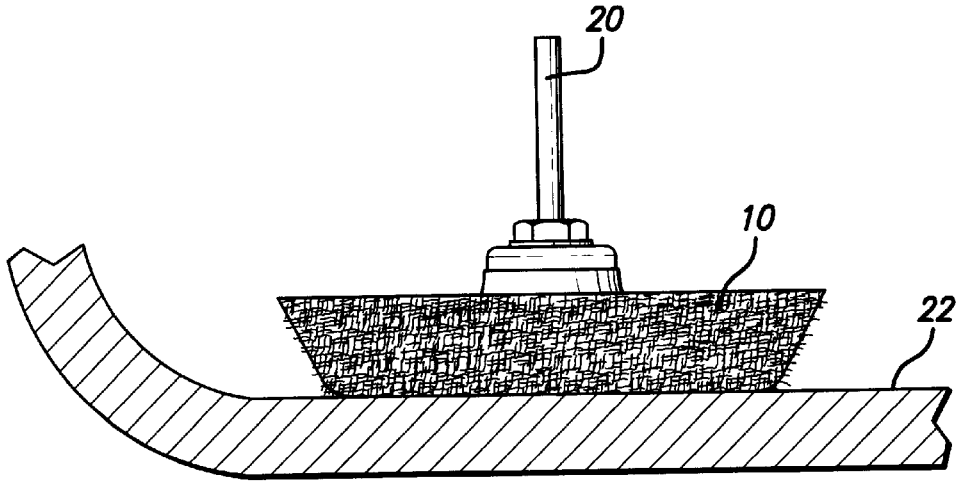
FIG. 5 is a perspective view of the non-woven abrasive disk of FIG. 1 on a workpiece with an interior curved surface.

In the past, non-woven abrasive articles have typically been shaped as a relatively a flat two-dimensional disk, with a flat two-dimensional working surface 15. The first embodiment of the present invention is a method for preforming a non-woven abrasive, such as a flat disk or other two-dimensional sheet of a non-woven abrasive, into a predetermined three-dimensional shape. This allows, for example, the edges or perimeter region 30 of the article 10, such as a disk, to be curved up and away from the workpiece 22 as illustrated in FIG. 5. The first step of this method is to heat the non-woven abrasive article 10 to a temperature near or above its plasticizing temperature. This can occur during the curing of the binder 16 used in manufacturing the non-woven abrasive article 10, during the process of attaching the shaft 20 or the connection for the shaft, or at any time during the manufacturing process, or at any time thereafter.

As used herein, the plasticizing temperature is the temperature at which the non-woven abrasive fabric softens to become more readily deformable and formable in a manner where it will retain its shape and structural integrity after it cools. The plasticizing temperature includes any temperature which will allow for deformation of the non-woven abrasive fabric by plastic flow (as opposed to rupture) within a commercially reasonable period of time. Due to the composite nature of the typical non-woven abrasive fabric, the plasticizing temperature will vary from one non-woven abrasive fabric to another. Typically, the plasticizing temperature is above the operating temperature of the disk. For commonly used non-woven abrasives, the plasticizing temperature can be as low as 75° C. Preferably, the nonwoven abrasive article 10 is heated to 200° C. to generally ensure that the plasticizing temperature is reached.

It is believed that the plasticizing temperature is near the glass transition temperature of the binder 16 and/or fibers used in manufacturing the non-woven abrasive article 10, but this is not always the case. The glass transition temperature is characterized by a rather sudden and reversible transition from a harder and more rigid condition to a more flexible or elastomeric condition. This transition occurs when the polymer molecule chains, normally coiled, tangled and motionless at temperatures below the glass transition range, become free to rotate and slip past each other.

Figure 6:
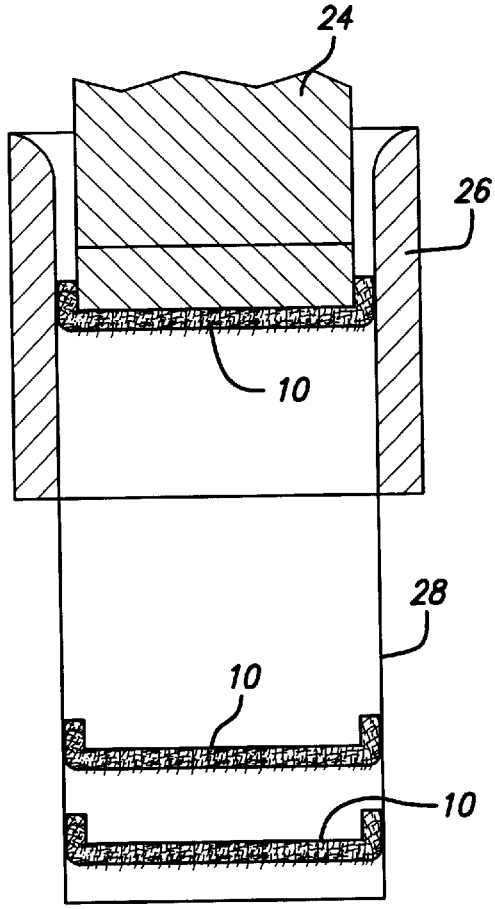
FIG. 6 is a schematic illustration of a piston, die and storage container suitable for manufacturing the non-abrasive disk of FIG. 1.

The second step of this method involves forming the non-woven abrasive article 10 into a predetermined three-dimensional shape. Preferably, the deformation will be in a direction perpendicular to the major surface 15 of the non-woven abrasive article 10. For example, a thin disk (relative to the diameter of the disk) of a non-woven abrasive can be pushed by a piston 24 into a cylindrical die 26 with a diameter of slightly less than the diameter of the disk 10, as schematically illustrated in FIG. 6. This can result in forming the disk 10 into the mushroom shape illustrated in FIGS. 1, 2, 4 & 5. Numerous other methods of forming the non-woven abrasive article 10 will be readily apparent to those skilled in the art.

The third step of this method is to maintain the three-dimensional shape of the non-woven abrasive article 10 while it cools below its plasticizing temperature. The three-dimensional shape of the non-woven abrasive article can be maintained by various methods. For example, the previously described disk 10 which is forced into a cylindrical die 26 can simply be left in the die 26 to cool. In the alternative, the disk 10 may be forced through the die 26 and allowed to cool in a separate storage container 28 which maintains the shape of the disk 10. Likewise, the shape of the disk 10 may be maintained by rapidly cooling the disk 10 using air or other means so that the disk 10 is cooled below its plasticizing temperature before it has an opportunity to return to its original shape. The shape of the disk 10 may also be maintained by use of a short cardboard or plastic cylinder. In a preferred embodiment of this method, the heated disk 10 is placed on top of the opening of the short cylinder and a heated piston 24 is used to force the disk 10 into the cylinder and maintained in contact with the disk 10 for a sufficient period of time to cure the disk 10 or ensure the disk 10 will retain the predetermined shape. The piston is then withdrawn and the formed disk 10 is stored in the cylinder until it is ready for use. A person skilled in the art will recognize many alternative methods for maintaining shape of the non-woven abrasive article 10 while it cools below its plasticizing temperature.

It is to be understood that although the first embodiment is described in terms of a first, second and third step, such a description is merely the preferred sequence, and the present invention does not necessarily require or imply that particular sequence of steps. For example, the non-woven article can be formed into the predetermined three-dimensional shape before it is heated to its plasticizing temperature.

The second embodiment of the present invention is an abrasive article 10 comprising the non-woven abrasive fabric described above, where a portion of the non-woven abrasive fabric is preformed in a direction perpendicular to the major surface 15 of the article 10. A preferred example of such an article 10 is illustrated in FIGS. 1, 2, 4 & 5 showing a mushroom-shaped abrasive article 10. This mushroom-shaped article 10 is generally in the shape of a disk and is made of uniformly thick non-woven abrasive fabric. When the abrasive article 10 is intended to be used on a concavely-shaped workpiece or a workpiece with an interior curved surface, as illustrated in FIG. 5, it is desirable to use a non-woven abrasive disk 10 which is preformed to form a substantially convex surface in contact with the workpiece 15. This can be accomplished by forming the non-woven abrasive disk 10 so that the perimeter region 30 of the disk 10 (i.e., the region of the disk near the perimeter of the disk) curves away from the workpiece 22, by, for example, having the disk 10 curve away more rapidly from a flat workpiece 22 near the perimeter region 30 of the disk 10, as illustrated on the right half of FIG. 5. In order to prevent the perimeter of the disk from gouging the workpiece, it is also desirable to taper the thickness of the disk 10 near its perimeter. An example of such taper is illustrated in FIG. 7.

The third embodiment of the present invention is an article 10 comprising a piece of the non-woven abrasive fabric described above, wherein the article is rotatable about an axis of rotation 32. This axis of rotation 32 is typically the axis of the shaft 20 which is attached to the article 10 for use with a grinder or other power-driven rotary tool. The non-woven abrasive article 10 is preformed to bend away from a plane 34 perpendicular to the axis of rotation 32. Preferably, the abrasive article 10 is symmetrical about the axis of rotation 32, to allow a uniformly shaped abrading surface of the non-woven abrasive article 10 to contact the workpiece 22 while the abrasive article 10 is rotated about the axis of rotation 32.

Figure 7:
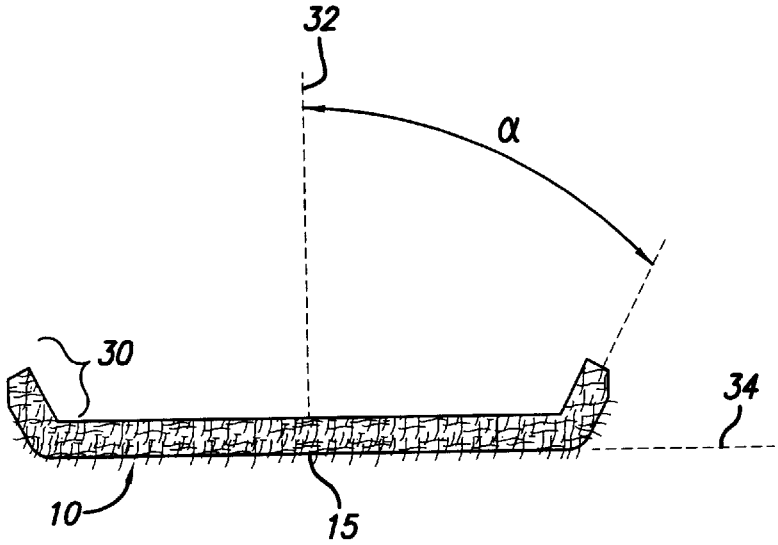
FIG. 7 is a cross-sectional view of an abrasive article of the invention.

In one preferred embodiment, the abrasive article 10 is a disk-shaped piece of non-woven abrasive fabric, and the perimeter region 30 of the disk is bent away from the plane 34 perpendicular to the axis of rotation 32, to form a convex surface relative to a plane 34 perpendicular to the axis of rotation 32, as illustrated in FIG. 7.

In the alternative, it may be desirable for certain applications to have the perimeter region 30 of the disk deformed at a uniform angle α relative to the axis of symmetry 32. In particular, a uniform angle α of between 0 degrees and 60 degrees has proven to be particularly workable in the surface finishing of concave surfaces or surfaces with an interior curve, with an angle α of 0° proving especially desirable in most applications. In addition, an angle α of more than 90° degrees may be desirable in certain circumstances.

The fourth embodiment of the present invention is the article 10 resulting from the steps generally described in the first embodiment. The fifth embodiment is similar to the first embodiment, but the non-woven abrasive article is heated to its glass transition temperature and cooled below its glass transition temperature while deformed.

The sixth embodiment of the present invention is a method for manufacturing a non-woven abrasive article in a three-dimensional shape using one or more thermosetting resins as a binder. A thermosetting resin is a material, such as an epoxy or polyester resin, which "thermosets" or "cures" by undergoing a chemical reaction by polymerization or condensation with or without the aid of catalysts or curatives through the action of heat, ultraviolet light, or other commonly known curing energies, to become a relative insoluble and non-reformable substances. Thermosetting resins generally develop a well bonded three dimensional structure upon curing. Once hardened or cross-linked, thermosetting resins will generally decompose rather than melt. Examples of thermosetting resins include alkyd, allyl phthalate, epoxy, certain phenolic materials, polyester, resorcinol formaldehyde, vinyl ester, urea formaldehyde and melamine formaldehyde.

A number of thermosetting resins have an intermediate stage prior to completion of curing, commonly known in the industry as "B-stage." In the B-stage, these materials swell in contact with certain liquids and soften when heated, but do not dissolve in some liquids.

An example of a preferred embodiment of the present invention consists of using a thermosetting phenolic resin to manufacture an abrasive article. A lofty three-dimensional non-woven web of 60 denier nylon fabric approximately ¼ inch thick is needle punched to a woven nylon scrim. The non-woven web is coated with an abrasive slurry consisting of 100 grit aluminum oxide suspended in the phenolic resin binder. The abrasive slurry coating is dried by passing the coated non-woven fabric through an impingement dryer at 120° C. for five minutes, resulting in a supple, dry B-stage coating.

Three inch diameter abrasive disks are then cut from the coated non-woven B-stage fabric using a steel rule die, and a shaft attachment mechanism is attached to the center of each disk. Six of the individual abrasive disks are then sequentially pushed into a ten inch long cylindrical aluminum tube having an outer diameter of 3 inches and an inner diameter of 2 ½ inches, which functions as a die 26, using a cylindrical tube having an outer diameter of 2 ⅛ inches and an inner diameter of 1 inch, which functions as a piston 24. The formed abrasive disks 10 are positioned in the aluminum tube so that they are barely touching each other.

The aluminum tube containing the formed abrasive disks 10 is then placed in a 175° C. oven for 10 minutes to cure the formed abrasive disks 10. The aluminum tube containing the formed abrasive disks 10 is then removed from the oven, and the formed abrasive disks 10 are pushed out of the tube and allowed to air-cool. The resulting mushroom-shaped abrasive articles 10 are less susceptible than the other abrasive articles described herein to subsequently changing their three-dimensional shape due to absorbsion of moisture from the atmosphere, heat generated during their use, or other factors.

Although preferred embodiments have been described in detail, it will be appreciated that changes and modifications to the described embodiments can be made by those skilled in the art without departing from the spirit and scope of the invention. In addition, the specific composition and three-dimensional shape of the abrasive article 10 of the present invention is highly customizable to the particular application, without departing from the spirit and scope of the invention.

What is claimed is:

1. A method for manufacturing an abrasive article, comprising the steps of:

(a) heating at least a portion of a lofty non-woven abrasive article to its plasticizing temperature;

(b) forming the non-woven abrasive article into a predetermined three-dimensional shape; and (c) maintaining the three-dimensional formation of the non-woven abrasive article while it cools below its plasticizing temperature.

2. The method of claim 1, wherein the non-woven abrasive article is initially in the shape of a thin disk and comprises a lofty, three-dimensional web of interlaced fibers, and a binder and abrasive particles attached to the fibers.

3. The method of claim 2, wherein the non-woven abrasive article further comprises a woven scrim backing.

4. The method of claim 2, wherein the non-woven abrasive article further comprises multiple layers of a lofty non-woven fabric, which are bonded to each other.

5. The method of claim 2, wherein the predetermined shape is a mushroom shape.

6. The method of claim 2, wherein the non-woven abrasive disk is formed by pushing the disk into a die and wherein the formed non-woven abrasive disk is maintained in the die until it has cooled below its plasticizing temperature.

7. The method of claim 2, wherein the formed non-woven abrasive disk is cooled below its plasticizing temperature at least partially in a storage container.

8. A method for manufacturing an abrasive article, comprising the steps of:

(a) heating at least a portion of a lofty non-woven abrasive article to its glass transition temperature;

(b) forming the non-woven abrasive article into a predetermined three-dimensional shape; and (c) maintaining the formation of the non-woven abrasive article while it cools below its glass transition temperature.

9. The method of claim 8, wherein the non-woven abrasive article is initially in the shape of a thin disk and comprises a lofty, three-dimensional web of interlaced fibers, and a binder and abrasive particles attached to the fibers.

10. The method of claim 9, wherein the non-woven abrasive article further comprises a woven scrim backing.

11. The method of claim 9, wherein the non-woven abrasive article further comprises multiple layers of a lofty non-woven fabric, which are bonded to each other.

12. The method of claim 9, wherein the predetermined shape is a mushroom shape.

13. The method of claim 9, wherein the non-woven abrasive disk is formed by pushing the disk into a die and wherein the formed non-woven abrasive disk is maintained in the die until it has cooled below its glass transition temperature.

14. The method of claim 9, wherein the non-woven abrasive article is cooled below its glass transition temperature at least partially in a storage container.

15. A method for manufacturing an abrasive article comprising heating a non-woven abrasive article comprising a lofty, three-dimensional web of interlaced fibers and at least one thermosetting binder and abrasive particles attached to the fibers to its deformation temperature and forming the abrasive article into a predetermined three-dimensional shape.

16. The method of claim 15, wherein at least one thermosetting binder is in a B-stage when the non-woven abrasive article is formed.

17. The method of claim 16, wherein the non-woven abrasive article is initially in the shape of a thin disk.

18. The method of claim 17, wherein the non-woven abrasive article further comprises a woven scrim backing.

19. The method of claim 17, wherein the non-woven abrasive article further comprises multiple layers of a lofty non-woven fabric which are bonded to each other.

20. The method of claim 17, wherein the predetermined shape is a mushroom shape.

21. The method of claim 17, wherein the non-woven abrasive disk is formed by pushing the disk into a die and the non-woven abrasive is thermoset while the disk is in a three-dimensional shape.

* * * * *